US007569004B2

(12) United States Patent
Kolomeir

(10) Patent No.: US 7,569,004 B2
(45) Date of Patent: Aug. 4, 2009

(54) WEIGHT LIFTING SIMULATOR APPARATUS

(76) Inventor: Joseph Kolomeir, 220 Bannantyne North, Montreal West, QBC (CA) H4X 2C2

( * ) Notice: Subject to any disclaimer, the term of this patent is extended or adjusted under 35 U.S.C. 154(b) by 297 days.

(21) Appl. No.: 11/643,854

(22) Filed: Dec. 22, 2006

(65) Prior Publication Data

US 2007/0142187 A1 Jun. 21, 2007

Related U.S. Application Data

(63) Continuation-in-part of application No. 11/434,169, filed on May 16, 2006, now abandoned, which is a continuation-in-part of application No. 11/293,374, filed on Dec. 5, 2005, now abandoned.

(51) Int. Cl.
*A63B 21/008* (2006.01)

(52) U.S. Cl. ..... 482/113; 482/92; 482/137

(58) Field of Classification Search ..... 482/53, 482/58, 59, 72, 73, 92, 96, 97, 111–113, 482/121, 129

See application file for complete search history.

(56) References Cited

U.S. PATENT DOCUMENTS

| | | | | |
|---|---|---|---|---|
| 3,387,843 | A | 6/1968 | Cnandler | |
| 3,638,941 | A * | 2/1972 | Kulkens | 482/113 |
| 3,905,599 | A * | 9/1975 | Mazman | 482/98 |
| 4,387,894 | A * | 6/1983 | Baumann | 482/112 |
| 4,426,077 | A * | 1/1984 | Becker | 482/92 |
| 4,746,115 | A | 5/1988 | Lahman | |
| 5,016,872 | A * | 5/1991 | Lee | 482/58 |
| 5,318,490 | A * | 6/1994 | Henderson et al. | 482/53 |
| 5,527,245 | A * | 6/1996 | Dalebout et al. | 482/54 |
| 5,605,524 | A | 2/1997 | Husted | |
| 5,622,527 | A * | 4/1997 | Watterson et al. | 482/53 |
| 5,653,667 | A * | 8/1997 | Reyes | 482/121 |
| 6,652,429 | B2 | 11/2003 | Bushnell | |
| 7,462,141 | B1 * | 12/2008 | Raboin et al. | 482/112 |
| 7,491,159 | B2 * | 2/2009 | Patterson | 482/112 |
| 2003/0115955 | A1 | 6/2003 | Keiser | |
| 2005/0032612 | A1 | 2/2005 | Keiser | |
| 2005/0101464 | A1 * | 5/2005 | Campitelli | 482/142 |
| 2005/0272577 | A1 * | 12/2005 | Olson et al. | 482/123 |
| 2006/0019807 | A1 * | 1/2006 | Husted et al. | 482/128 |
| 2009/0075793 | A1 * | 3/2009 | Trainor | 482/112 |

FOREIGN PATENT DOCUMENTS

GB 2128885 A * 5/1984

* cited by examiner

*Primary Examiner*—Loan H Thanh
*Assistant Examiner*—Victor K Hwang
(74) *Attorney, Agent, or Firm*—Equinox Protection; Franz Bonsang, Patent Agent

(57) ABSTRACT

Weight lifting simulator apparatus includes a primary pneumatic cylinder providing the principal resistance for simulating weight lifting exercise with at least one secondary cylinder in free fluid interconnection with the primary cylinder whereby constant and balanced loading is achieved, with provisions for dynamic simulation of weight inertia effect, and control thereof, as in lifting a real weight. The primary and the secondary cylinders are associated with a guideway, the primary cylinder being fixed to the guideway and the secondary cylinder being slidable relative to the guideway and pivotable relative to the piston rod of the primary cylinder. Variation of the securement position of the primary cylinder on the guideway is available and valving is provided in the fluid interconnection.

27 Claims, 14 Drawing Sheets

WEIGHT LIFTING SIMULATOR APPARATUS

CROSS REFERENCE TO RELATED APPLICATIONS

The present application is a continuation-in-part (C.I.P.) of application Ser. No. 11/434,169, filed on May 16, 2006, now abandoned, that is a continuation-in-part (C.I.P.) of application Ser. No. 11/293,374, filed on Dec. 5, 2005, now abandoned.

FIELD OF THE INVENTION

The present invention relates to weight lifting simulator apparatus for exercise or therapeutic use.

BACKGROUND OF THE INVENTION

Weight lifting simulator apparatus of conventional form includes the provision of weights giving a resistance loading, which may be varied by selection, for a user who activates the apparatus using a gripping handle operating on a cable and pulley or lever mechanism. It is also known to employ such simulator apparatus that includes either a resistance arrangement on its own, being either elastic, pneumatic or the like, or in combination with weights. Examples of such apparatus are disclosed in US Patent application publication No. US 2003/0115955 to Keiser, which comprises a compact resistance unit that houses a pneumatic cylinder providing resistance through a block-and-tackle mechanism to a handle operable by a user. US Patent application publication No. US 2005/0032612 to Keiser describes a combined weight and pneumatic resistance exercise apparatus. U.S. Pat. No. 6,652,429 to Bushnell discloses an exercise machine with controllable resistance. In most prior art apparatus control of the resistance level is effected by the use of a simple valve in conjunction with an air compressor which is expensive, cumbersome, noisy and require external power source. All these apparatuses have systems that allow control of some static inertial effect of weight simulation since the control effect depends of the position of the different components of the respective mechanism. None of these apparatuses includes a control of the dynamic inertial effect of weight that depends on the speed the different components move relative to one another during operation of the apparatus, by increasing the inertial effect thereof, especially during movement of the apparatus.

Accordingly, there is a need for an improved weight lifting simulator apparatus, which provides the facility for a constant application of resistance at any given setting.

SUMMARY OF THE INVENTION

It is therefore an object of the present invention to provide an improved weight lifting simulator apparatus.

An advantage of the present invention is that the weight lifting simulator apparatus includes a typically controllable dynamic inertial effect simulation of weight displacement in addition to a static inertial effect; the dynamic inertia effect being increased, this increase being dependent on the speed of the activation movement of the apparatus. Typically, the apparatus enables, through a relatively simple mechanism, simulation of weight lifting with a control of the amount of dynamic inertial effect, from constant force with negligible inertial effect all along its extension path to a more real inertial effect feel of the weight as found in conventional weight lifting apparatuses using real physical weights.

An advantage of the present invention is that the apparatus is of compact design and construction using elastic or pneumatic technology, and preferably compressible elastic fluid technology for the simulation of weight resistance without the use of active compressor.

Another advantage of the present invention is that the apparatus allows a ready control and modulation of the weight resistance and/or the dynamic weight inertia effect simulation by simple manipulation of the configuration.

According to the present invention there is provided a weight lifting simulator apparatus comprising a frame, a guideway pivotally mounted on the frame for activation by a user, a primary load resistant member having generally opposed first and second primary ends respectively movably mounted on the frame and pivotally and adjustably securable to the guideway at a desired position therealong, at least one secondary load resistant member having generally opposed first and second secondary ends respectively mounted in pivoting fashion in relation to and adjacent the second primary end and connected to a slider associated with and movable relative to the guideway so as to remain substantially perpendicular thereto, the primary and secondary load resistant members being operatively interconnected in such manner as to provide a generally constant resistance with dynamic weight inertial effect upon activation of the guideway by the user, whereby in use upon activation of the guideway the user encounters a dynamically reduced resistance for increased weight inertial effect from both the primary and secondary load resistant members after initial activation of the guideway depending on the displacement speed thereof.

In one embodiment, the first primary end is pivotally mounted on the frame and the second secondary end is pivotally mounted on the slider.

Typically, the primary and secondary load resistant members are fluid actuatable cylinders, and typically pull-type load resistant members.

In one embodiment, the primary and secondary cylinders are fluidly interconnected in such manner as to constantly provide a uniform internal pressure therein.

Conveniently, two secondary cylinders are provided, and mounted in parallel relative to one another.

In one embodiment, a clamp is provided for the securement of the second primary end to the guideway.

In one embodiment, a stepped adjustment mechanism is provided for the securement of the second primary end to the guideway.

Typically, the stepped adjustment mechanism is in the form of a rack, eventually arcuate, with a resiliently-loaded detent engageable with the interstices of the rack, and the resiliently-loaded detent is remotely operable by means of a cable actuable upon the detent.

Alternatively, the stepped adjustment mechanism includes a scalloped, typically arcuate, slot formed in the guideway, a cam-operable roller engageable with a selected one of the scallops in the slot.

Conveniently, the cam-operable roller is carried on a yoke having a bridge with a bridge collar mounted adjacent the second primary end, and a fixed collar connected adjacent to the first primary end having pivotally mounted thereon a lever carrying a cam operable upon the bridge collar of the yoke, whereby in use operation of the lever and the cam moves the cam-operable roller into or out of engagement with a scallop in the guideway slot.

In one embodiment, the slider associated with the guideway includes at least one roller or a linear type bearing engageable with the guideway.

Typically, the second secondary end is pivotally mounted on a pivot axis substantially intersecting a sliding axis of the slider moving relative to the guideway.

In one embodiment, the secondary load resistant member is further attached to the primary load resistant member in sliding manner through the agency of a mount providing for resiliently-biased linear movement and secured to and adjacent the second primary end so as to further dynamically increase weight inertial effect from both the primary and secondary load resistant members after initial activation of the guideway depending on the displacement speed thereof.

Typically, the guideway is pivotally mounted on the frame at a pivot axis and the linear movement is along a linear movement axis oriented towards the guideway in a direction away from the pivot axis relative to the first secondary end.

Conveniently, the linear movement axis is angularly adjustable relative to the guideway for adjustment of the dynamically increased weight inertial effect from the secondary load resistant member.

In one embodiment, the apparatus further includes a user handle connected to the guideway for activation thereof by the user.

Typically, a cable member and pulley arrangement connects the handle to the guideway.

Alternatively, the handle is mounted on an extension of the guideway extending longitudinally away from a pivot axis thereof.

In other embodiment, the second secondary end is either fixably or movably mounted on the slider.

In one embodiment, the first primary end slidably mounted on a guide rail of the frame so as to be virtually pivotally mounted on the frame.

In one embodiment, the second primary end is pivotally and adjustably securable to the guideway along an arcuate guide; and conveniently, the arcuate guide has a gradually decreasing radii curve shape about a pivot mounting point of said first primary end when leading away from a neutral position thereof in which said primary and secondary load resistant members are generally parallel to one another.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

Figure 1:
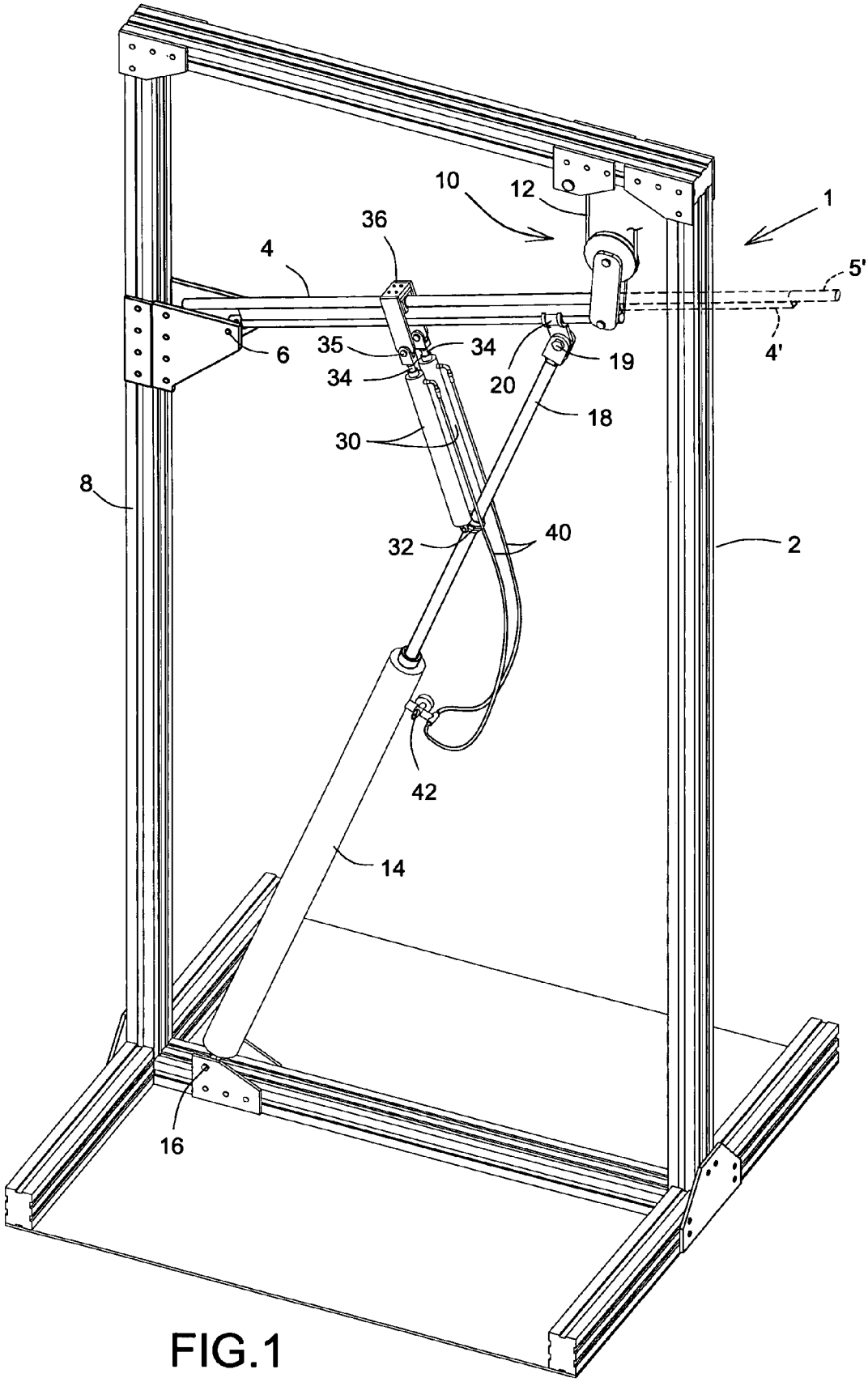
FIG. 1 is a simplified top perspective view of a weight lifting simulator apparatus in accordance with an embodiment of the present invention, showing the main cylinder positioned in a heavy-load simulation in an extended configuration.

With reference to the annexed drawings the preferred embodiments of a weight lifting simulator apparatus according to the present invention will be herein described for indicative purpose and by no means as of limitation. Although the following description describes the use of primary and secondary pneumatic cylinders, any elastic behavior load resistant members, such as elastic springs or the like, could be considered without departing from the scope of the present invention.

Referring first to FIGS. 1 to 4 there is shown a generally rectangular frame 2 of a weight lifting simulator apparatus 1, a guideway 4, or arm, being pivotally mounted thereon at pivot 6 on a side limb 8 thereof for rotation about a pivot axis between two limit angular positions (one position limiting stopper being the piston rod 18 fully retracted inside the cylinder 14 as detailed hereinbelow and shown in FIGS. 2, 4, 7, 8 and 9, the other being shown in FIG. 9 in dotted lines). The free end of the guideway 4 remote from its pivot 6 either pivotally carries a block-and-tackle arrangement diagrammatically depicted at 10, the arrangement 10 being connected to a suitable actuating handle 5 (see FIG. 5) via a rope or cable 12, or is provided with a longitudinal extension 4' and handle 5' (shown in dotted lines in FIG. 1) of the guideway 4 away from the pivot 6, for a user.

A primary load resistant member, typically a pneumatic cylinder 14 is movably, preferably pivotally, mounted at a first primary end 16 on the frame 2 as illustrated with its primary second end or piston rod 18 pivotally carrying a clamp 20, adjacent pivot 19, for registration with the guideway 4 at any desired and selected position therealong. In this embodiment, twin secondary load resistant members, typically pneumatic cylinders 30 are provided and have a first secondary end pivotally attached to a collar 32 for pivotal connection with and adjacent the end of the piston rod 18. The second secondary ends or piston rods 34 of the cylinders 30 are attached or connected, either fixedly or movably (see FIGS. 11*a* to 11*d* and corresponding details hereinbelow) and typically pivotally mounted, to a yoke in the form of a slider 36 bridging the guideway 4 and being slidable therealong, typically using a linear type bearing or the like. A pivot axis 35 of the secondary piston rods 34 is generally perpendicular and typically as close as possible to the sliding axis of the slider 36 for increased smoothness in the sliding motion, as shown in FIGS. 1 through 9. Preferably, the pivot axis 35 generally intersects the sliding axis of the slider 36. In operation, the slider 36 allows the secondary cylinders 30 to remain substantially perpendicular to the guideway 4 during pivotal displacement thereof.

The primary and secondary cylinders 14, 30 are typically fluidly interconnected, to generally keep all internal pressures uniform, by suitable hoses 40 which typically unite in a pressure control or fill/purge valve 42, such as a typical bicycle fill valve or the like, to eventually allow selective modification of the total amount of fluid, or fluid pressure, inside the cylinders 14, 30. The filling of the cylinders 14, 30 could be performed via a conventional manually or power activated pump. Obviously, more sophisticated pump mechanisms with predetermined pressure levels could also be considered without departing from the scope of the present invention; the more fluid there is inside the cylinders the more resistive the created force will be.

As shown in FIG. 1 the apparatus 1 has the guideway 4 in its maximum upward angular displacement or extension such that the primary cylinder 14 has had its piston as "fully extended" as possible by a user employing the block-and-tackle 10 and the rope 12, which is accordingly taut. The cylinder 14, which obviously still has a minimum volume of air therein, is in a heavy load simulation with the clamp 20 secured near the free end of the guideway 4 and the slider 36 of the secondary cylinders 30 having moved towards side limb 8 with their collar 32 locked to the rod 18 to remain substantially perpendicular to the guideway 4. This relative movement occasions free fluid interflow between the primary and secondary cylinders 14 and 30 thereby distributing the resistive force and providing a generally constant resistance to the user. Depending on the weight of the slider 36, the sliding displacement of the secondary cylinders 30 along the guideway 4 dynamically increases the weight inertial effect of the load simulator; i.e. the relatively small dynamic load reduction felt by the user, as would be naturally felt with a real weight being lifted, will be larger if the displacement speed of the slider 36 induced by the rotational displacement of the guideway 4 is larger.

Figure 2:
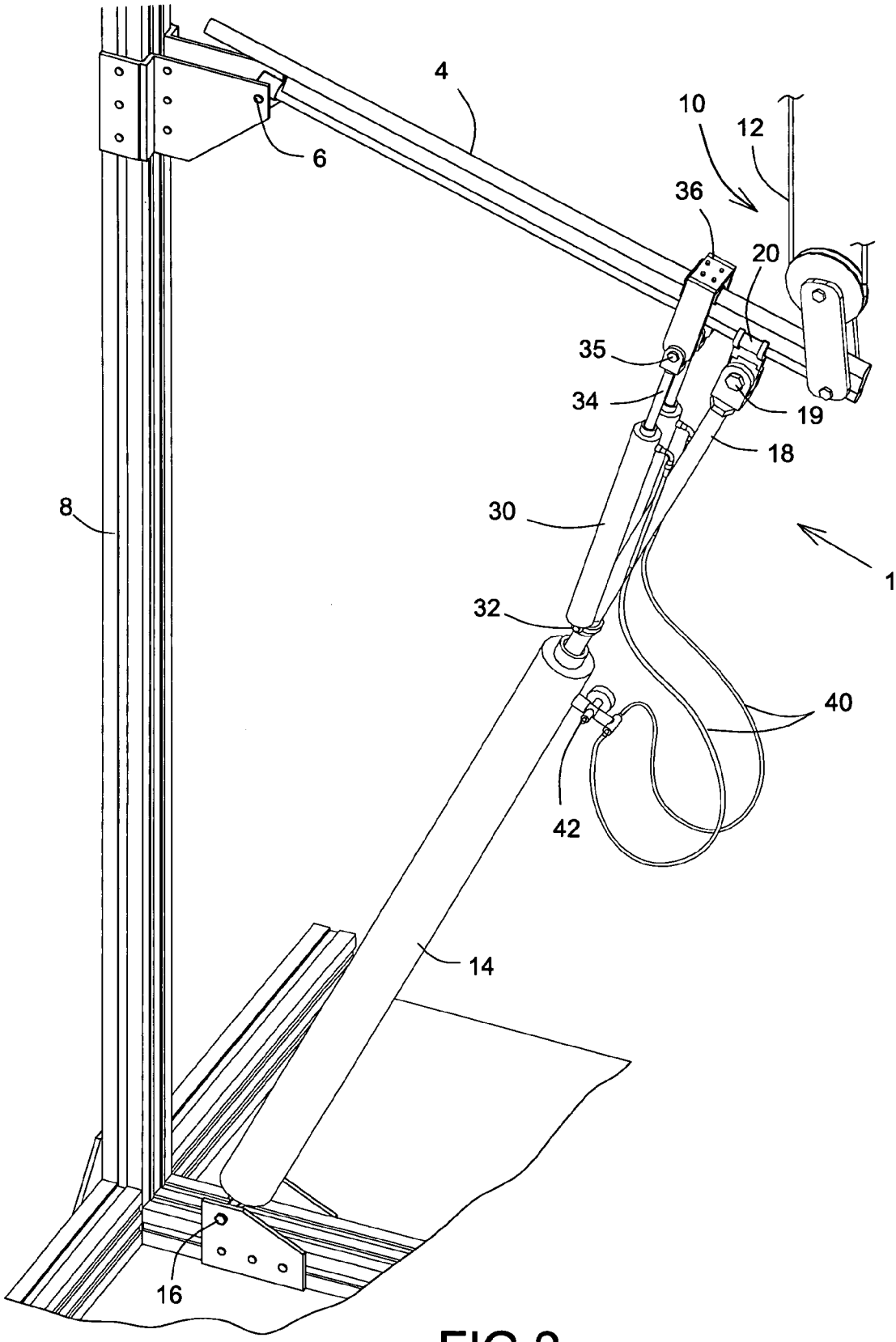
FIG. 2 is a partially broken and enlarged perspective view of the embodiment of FIG. 1, showing the main cylinder in a contracted configuration.
Figure 5:
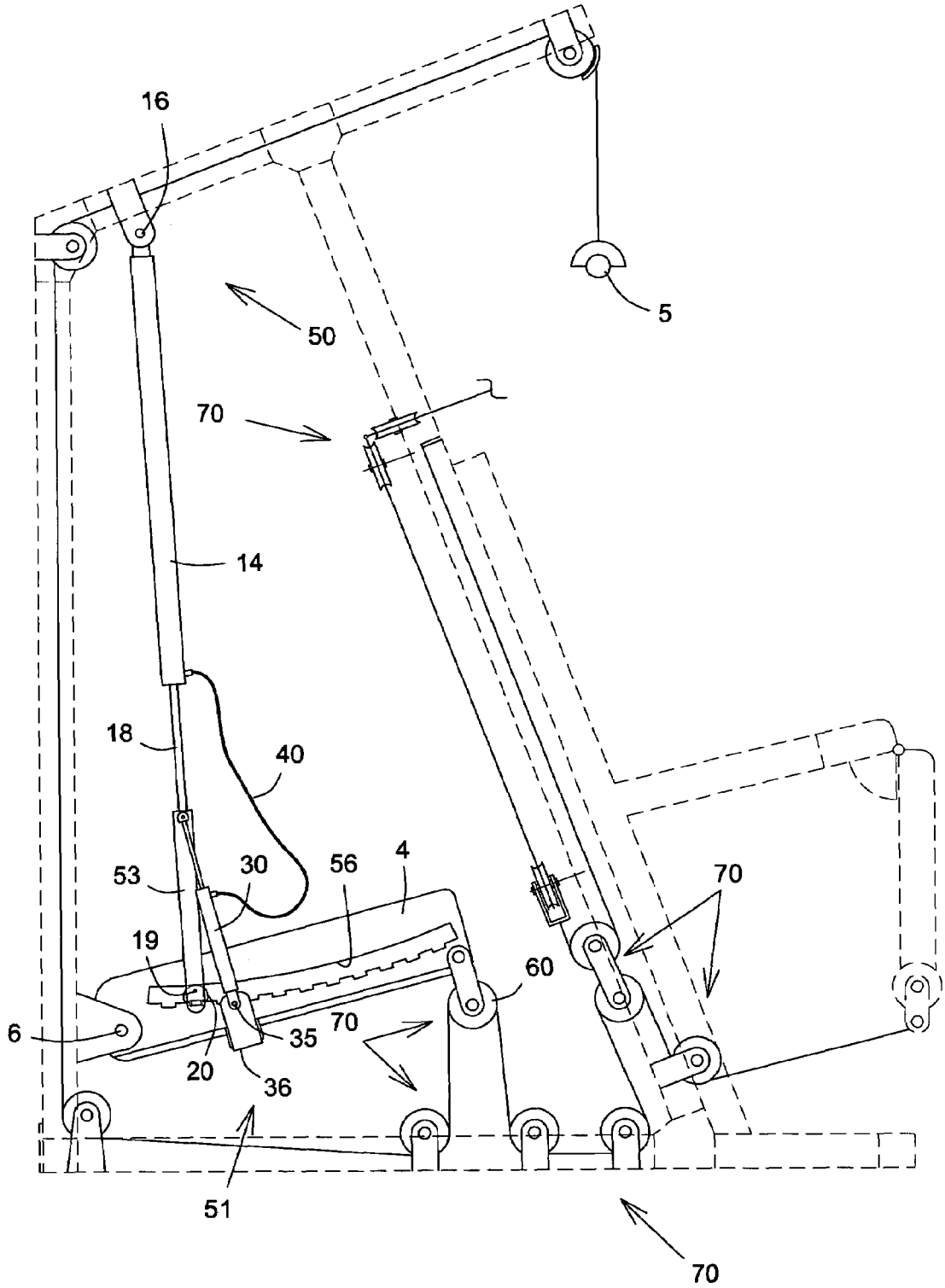
FIG. 5 is a simplified side elevational view of another embodiment of the present invention with the cylinder assembly mounted up side down.

FIG. 2 shows the cylinder 14 in a contracted (seating) position corresponding to a resting configuration of the apparatus 1 ensured by the built-in pressure inside the cylinders. In the apparatus resting configuration, the rope or cable 12 is released by the return stroke of the user with the handle 5 (as shown in FIG. 5) up to an abutment position against a stopper or the like (not shown) that could also be the handle 5 itself or even protectors thereof that would be blocked by the first pulley it encounters or the like. The slider 36 of the secondary cylinders 30 has moved along the guideway 4 towards the block-and-tackle 10, and this reciprocating movement is repeated as the user moves the rope 12 into a heavy load and then into a return or release position.

Figure 3:
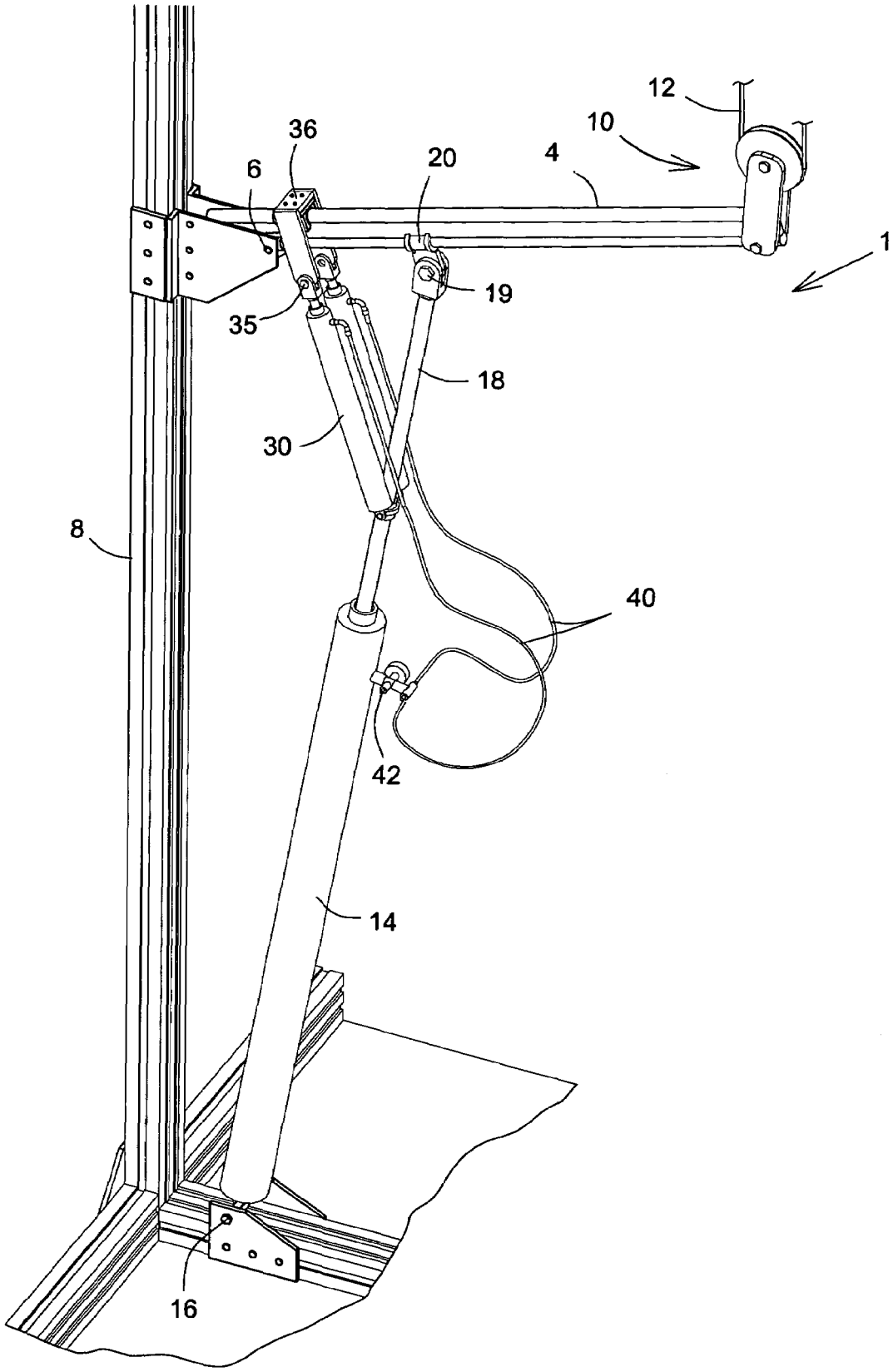
FIG. 3 is a view similar to FIG. 2, showing the main cylinder in an extended configuration, in a light-load simulation.
Figure 4:
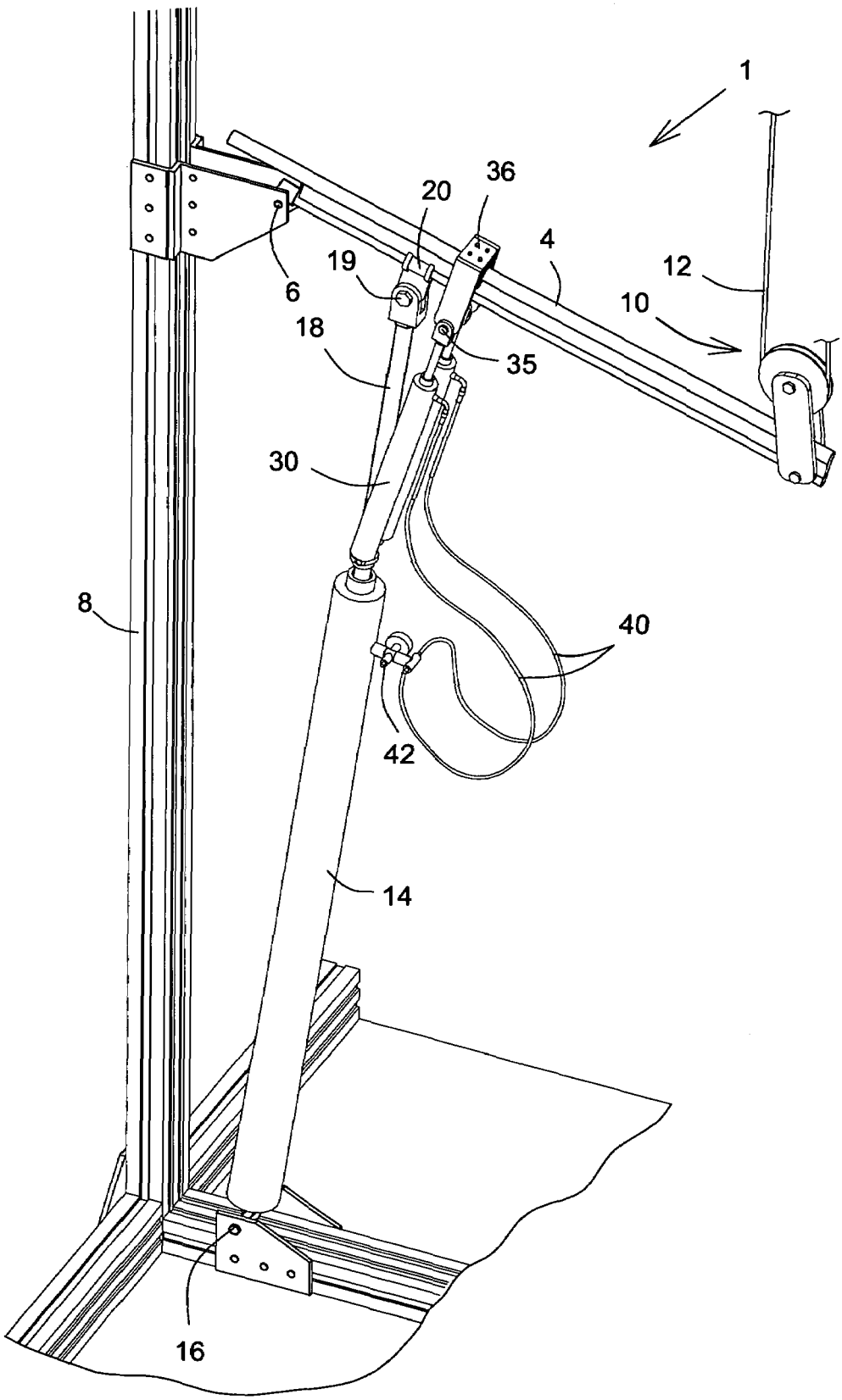
FIG. 4 is a view similar to FIG. 3, showing the main cylinder in a contracted configuration.

FIGS. 3 and 4 show the clamp 20 in a different position nearer to the pivot 6 of the guideway 4 with the rod 18 extended to a smaller extent than in FIGS. 1 and 2. The close position of the clamp 20 provides for a smaller lever length to the cylinder 14 on the guideway 4, associated with a smaller range of travel of the piston in the primary cylinder 14, give a lower resistance weight loading simulation. Again, the interflow of air between the cylinders with the sliding of the piston rods 34 on the guideway 4 provides for a balancing of force that gives a smooth and constant application of load resistance with dynamic weight inertia effect.

Figure 6:
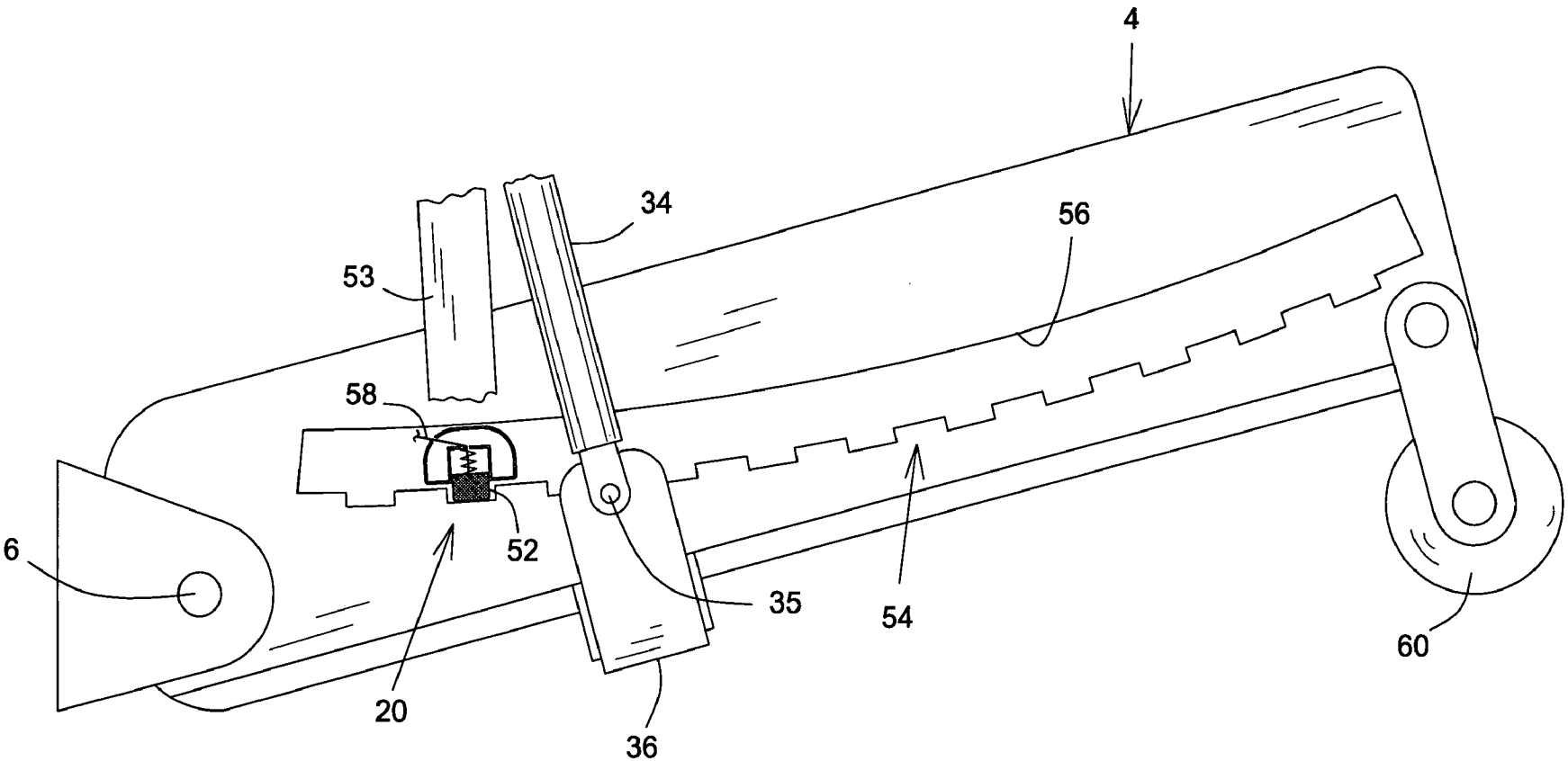
FIG. 6 is a partially broken and enlarged side view of the embodiment of FIG. 5.

Referring now to FIGS. 5 and 6, the primary cylinder 14 is pivotally attached to an upper region 50 of the apparatus 1 and the guideway 4 is pivoted at 6 in a relatively lower region 51 of the apparatus. The clamp 20 is in the form of a spring-loaded detent 52 registering and engaging with a rack 54 of arcuate form provided in a slot 56 within the guideway 4. The detent 52 is actuable by means of a wire or cable 58 and accordingly resetting the detent 52 in a recess of the rack will change the resistance loading of the primary cylinder 14 as with the first embodiment of FIGS. 1 to 4. The clamp 20 is pivotally carried by an arm 53 which is attached to the piston rod 18 of the primary cylinder 14. The slider 36 of the secondary cylinders 30 engages the guideway 4 in the manner shown in the drawings; the secondary cylinders 30 are connected in a similar manner to a collar (not shown) pivotally mounted on the piston rod 18.

The guideway 4 carries at the free end remote from its pivot 6 a pulley 60 which is one of an array 70 of pulleys provided for the apparatus 1 as shown. The cable 12 is reeved around the pulley 60 and upon appropriate movement of the cable the guideway 4 is caused to pivot about its mounting at 6. A pull on the cable causes tension therein and brings the guideway 4 into a downward path thus generating resistance via the compressed fluid in the primary and the secondary cylinders 14, 30 which are balanced due to the fluid flow therebetween via the hoses 40. The advantage of the arrangement is as previously indicated in relation to the first embodiment. However, the setting of the primary cylinder orientation relative to the guideway is fixed by virtue of the rack, which provides for predetermined incremental steps to give discrete modulation.

Figure 7:
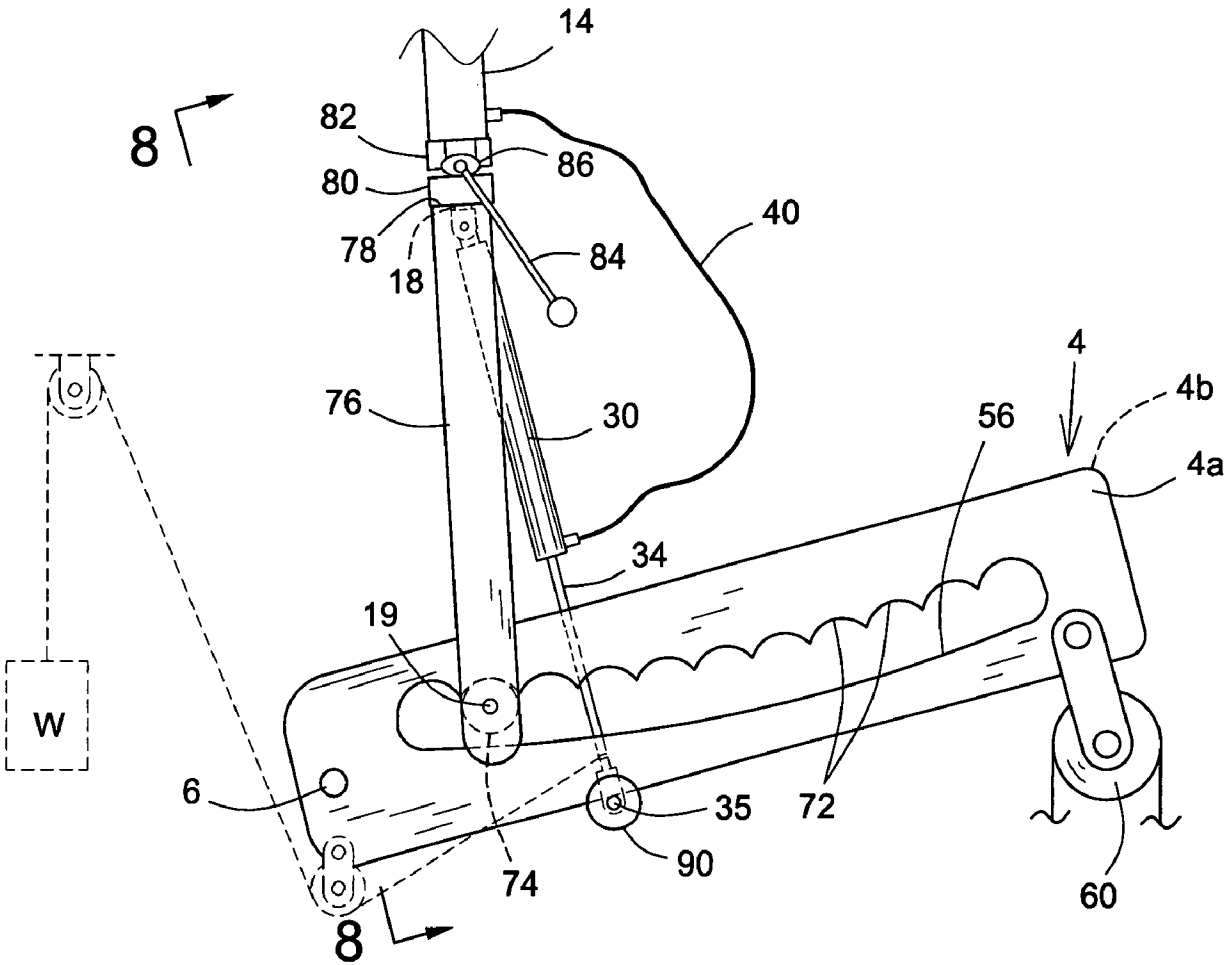
FIG. 7 is a view similar to FIG. 6, showing another embodiment of the present invention.
Figure 8:
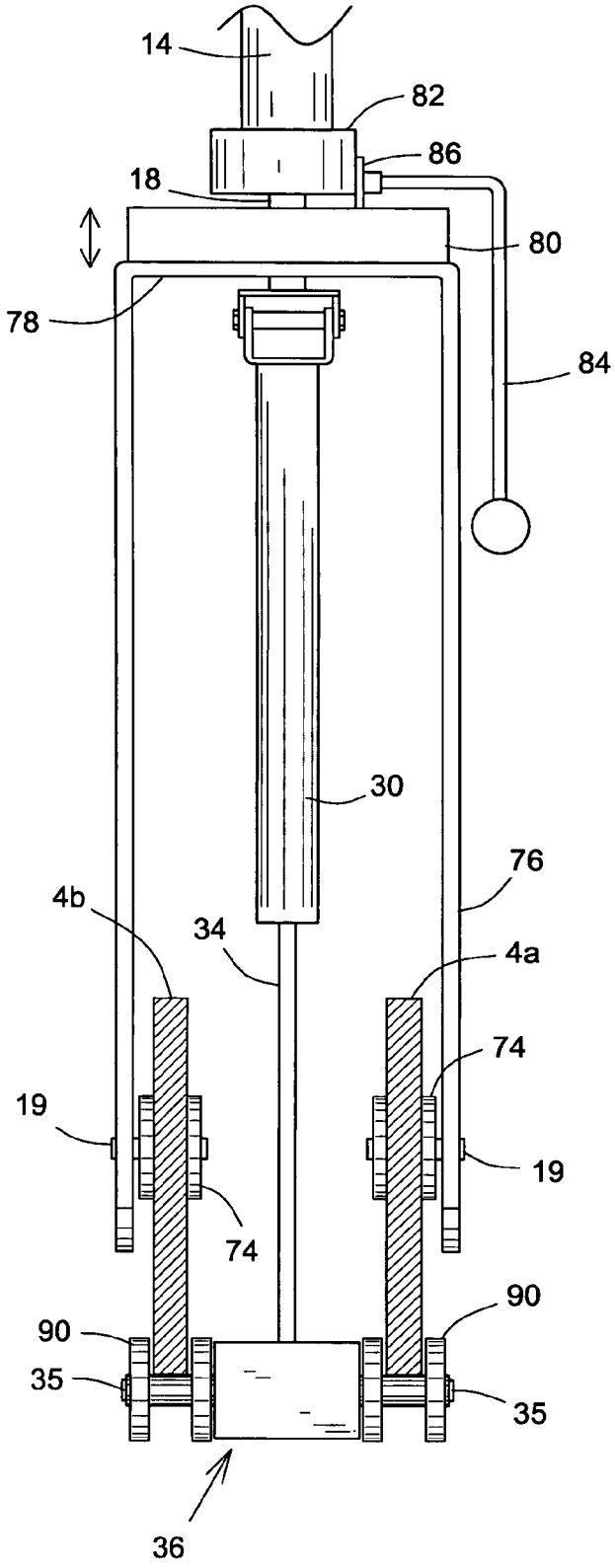
FIG. 8 is an enlarged section view taken along line 8-8 of FIG. 7.

With reference now to FIGS. 7 and 8 there is shown a variation on the embodiment illustrated in FIGS. 5 and 6 in that the guideway 4 is in two parts 4*a* and 4*b* generally parallel to each other; the slot 56 is formed in each part and is of scalloped form on its relatively upper margin, each scallop 72 being so shaped as to accommodate a roller 74 carried on a yoke 76 which embraces both parts as more clearly can be seen in FIG. 8. A bridge piece 78 of the yoke 76 is mounted on the piston rod 18 also connected to a collar 80 mounted thereon. A fixed collar 82 is provided on the cylinder 14 and carries an actuating lever 84 with a cam 86 that abuts the collar 80 when the apparatus 1 is in the resting configuration with primary cylinder 14 in a substantially contracted configuration, rotation of the lever and thus the cam occasioning movement of the yoke 76 to engage or disengage the rollers 74 in a respective scallop 72 as desired to change the setting and to fix the rollers in the required setting. The slider 36 comprises spool type rollers 90 which engage the lower side of each of the parts 4*a* and 4*b* as can be seen in FIG. 8. As shown in FIGS. 7 and 8, the pivot mounting 19 of the piston rod 18 would typically coincide with the axis of rollers 74 while the pivot 35 of the piston rods 34 would typically coincide with the rotation axis of the rollers 90. The operation of this embodiment is essentially the same as that of the previous embodiment except that the setting of the primary cylinder is effected by the interengagement of the rollers 74 with the scallops 72 in contrast to the rack formation and the locking of the setting is secured by the use of a cam operated lever arrangement.

Figure 9:
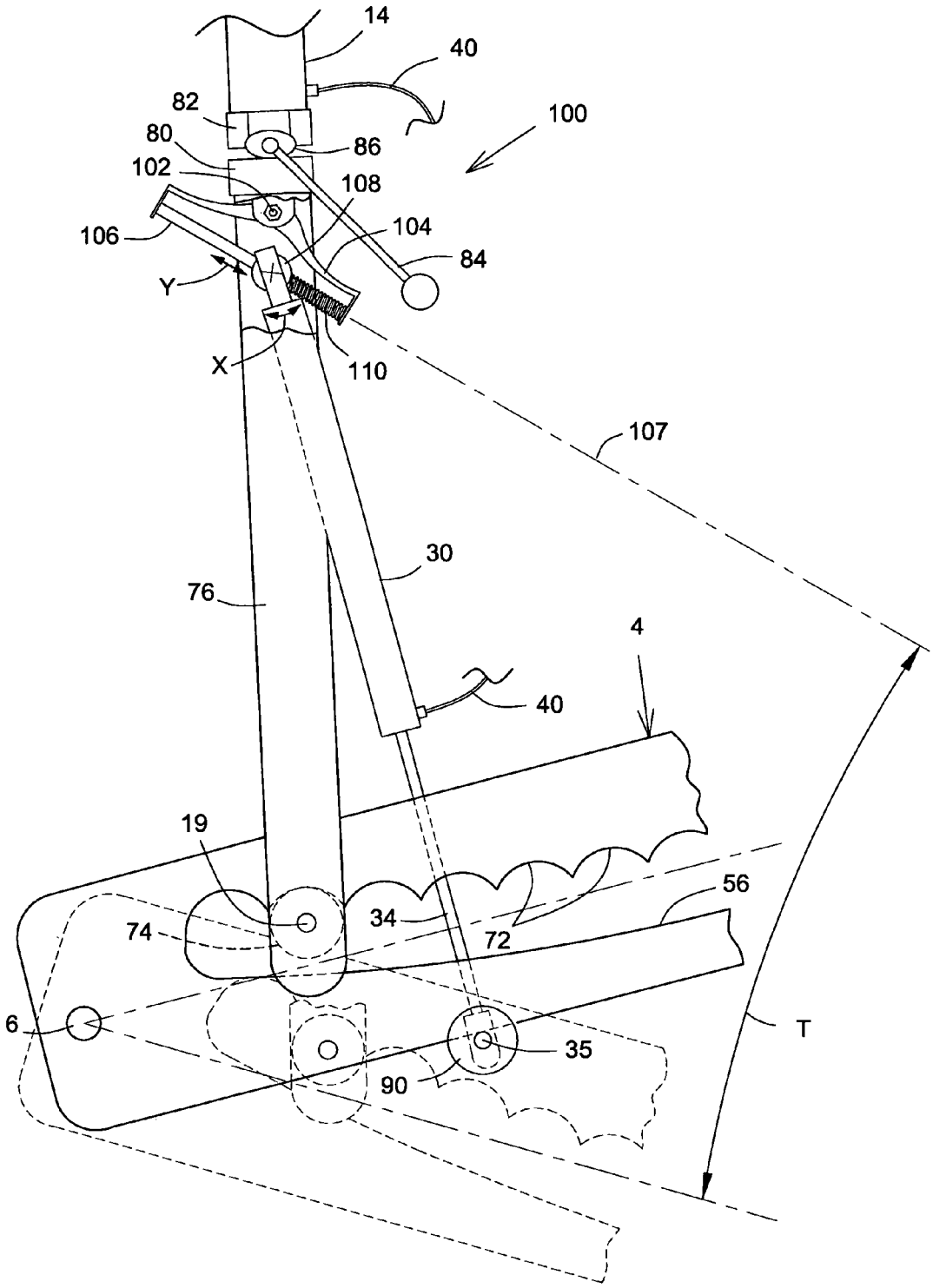
FIG. 9 is a view similar to FIG. 7, showing another embodiment of the present invention.

FIG. 9 depicts a variation of the embodiment of FIG. 7 in terms of the connection mount between the primary and secondary cylinders 14 and 30. The connection 100 provides for a linear displacement of the secondary cylinder(s) 30 relative to the rod 18 with a resilient bias giving a damping effect. In this connection, the connection 100 comprises a slideway bracket 104, tightly secured to the rod 18 at 102, holding a pin 106 on which the end 108 of the cylinder(s) 30 slides reciprocally, as shown by the straight arrow Y, as much as possible in a frictionless manner, typically via a linear bearing or the like. A spring 110 is provided on the pin 106 and thus gives a bias to the end of the cylinder(s) 30. Obviously, the end 108 of the cylinder(s) 30 is pivotally mounted relative to the pin 106 as shown by arrow X.

The pin 106 has its axis 107 (linear movement axis) that is typically angularly oriented towards the guideway 4 in a direction away from the pivot axis relative to the cylinder(s) 30, or towards the free end of the guideway 4 when the latter is in its limit angular position away from the main cylinder 14, as shown by angle T of FIG. 9 with the limit angular position of the guideway 4 shown in dotted lines. Obviously, when the angle T is properly set with the main piston rod 18 connected to the guideway 4 at its far most location relative to the pivot 6 (in a heavy load configuration, not illustrated), any other subsequent location of the piston rod 18 on the guideway 4 would be automatically set, with the effect of the connection 100 being the most apparent in that heavy load configuration where it is expected the most.

The provision of the connection 100 is to further dynamically increase the weight inertial effect of the load simulator by increasing the simulation of the weight reduction feeling occurring during the lifting movement when lifting real weight bars, depending on the speed of the movement. The secondary cylinder(s) 30 always tends to remain generally perpendicular to the guideway 4 while contracting as much as possible, thus having the first secondary end or cylinder(s) 30 slide toward the spring 110 upon lifting movement because of the angle of the pin axis 107. The biasing spring 110 is there to bias this displacement and prevent any shock that could occur, especially at the end of the linear displacement path along the pin 106.

Typically, the angular position of the mount connection 100 relative to the piston rod 18 can be adjusted, preferably incrementally, via an adjustment mechanism 102 such as a tightening bolt or the like, to control the additional dynamic weight inertia effect of the apparatus 1 provided by this connection 100.

The overall advantage of the present invention is to simulate weight lifting apparatus by the use of pneumatic cylinders with free interflow of air thus facilitating the achievement of constancy in terms of resistance.

Figure 10:
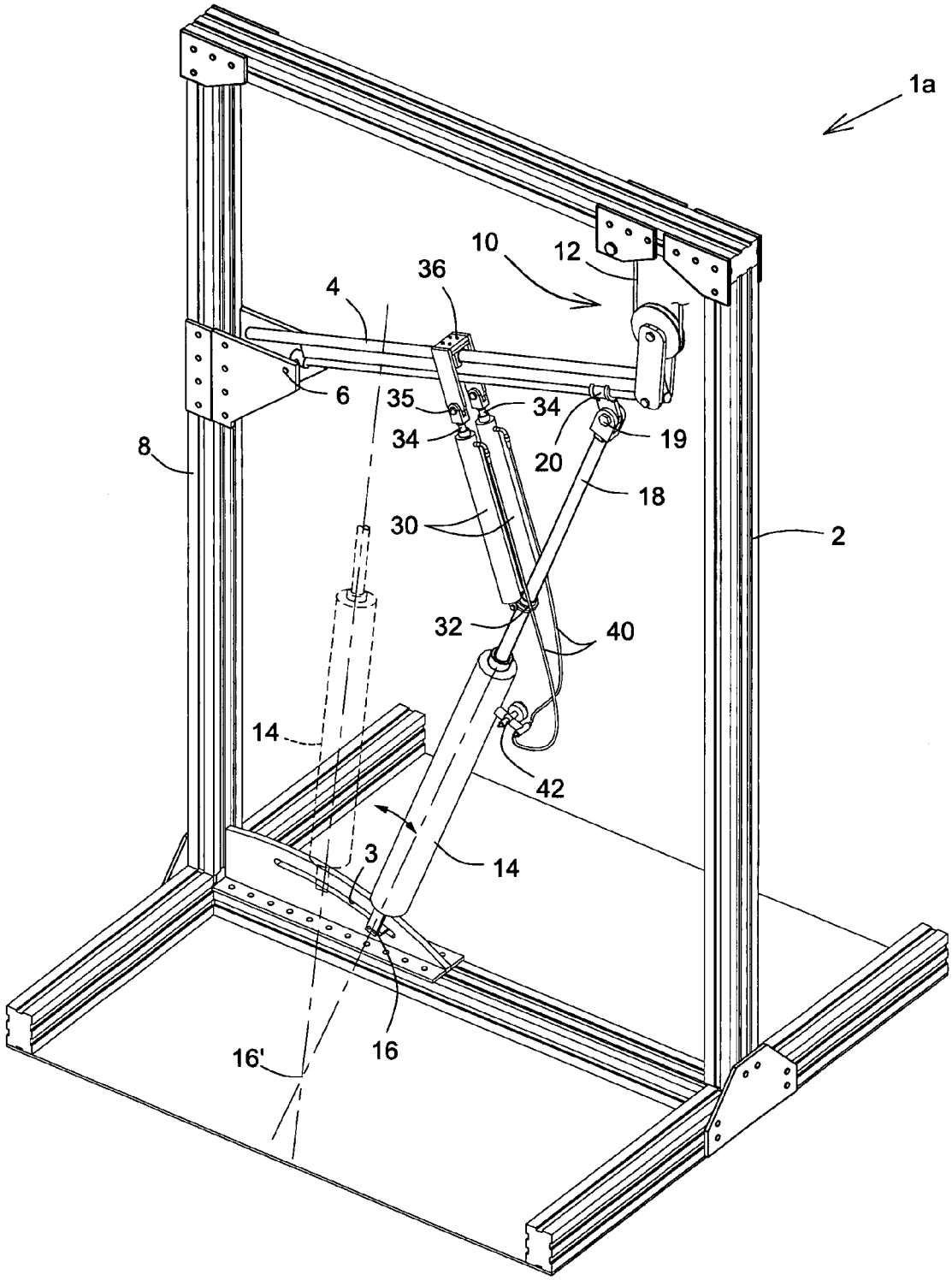
FIG. 10 is a view similar to FIG. 1, showing another embodiment of the present invention with the main cylinder movably mounted on the fame with a virtual pivot point.

Referring more specifically to FIG. 10, there is shown another embodiment 1*a* of the apparatus of the present invention in which the first primary end 16 of cylinder 14 is movably, typically slidably and non-pivotally, mounted on an arcuate guide rail 3 secured to the frame 2. The guide rail 3 provides for circular displacement of the first primary end about a virtual pivot 16' such that the primary load resistant member is virtually pivotally mounted on the frame. This mounting allow the use of a shorter primary cylinder 14, yet with similar volume as the long primary cylinder of FIGS. 1 through 9, i.e. similar reservoir, without affecting the weight lifting simulation characteristics of the apparatus 1*a*.

In order to vary the dynamic weight inertia effect of the apparatus 1, the second secondary ends or piston rods 34 could be connected in different ways to the slider 36, as shown in FIGS. 11*a* through 11*d*, as examples.

Figure 11A:
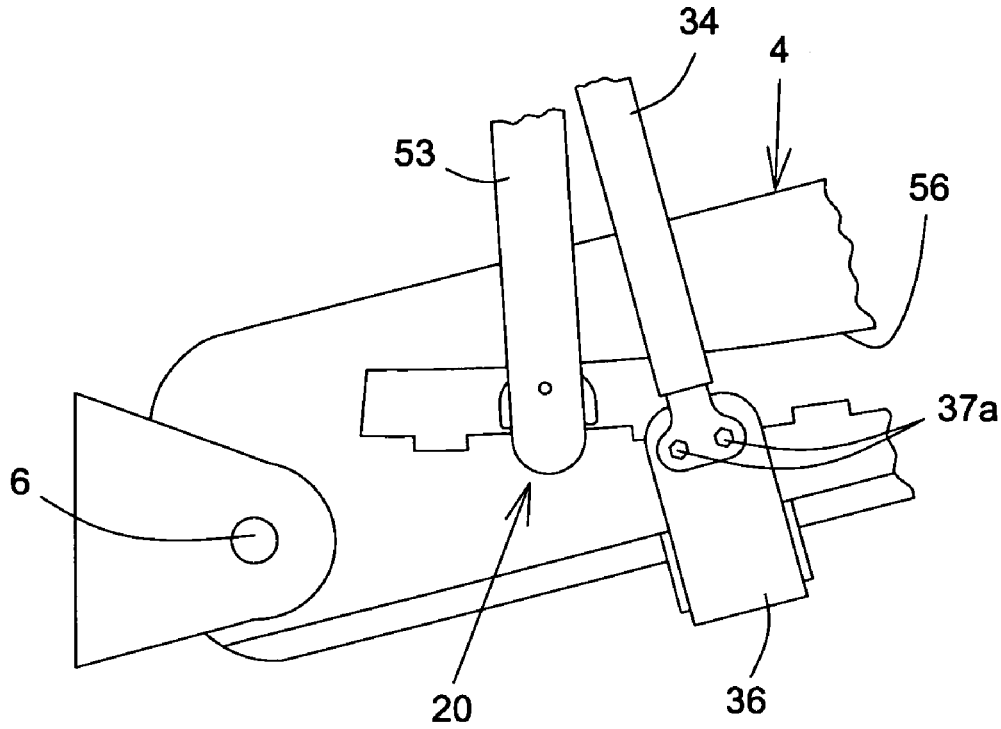
FIGS. 11*a* through 11*d* are enlarged broken views, showing different embodiments of the attachment of the secondary cylinder(s) to the slider.
Figure 11B:
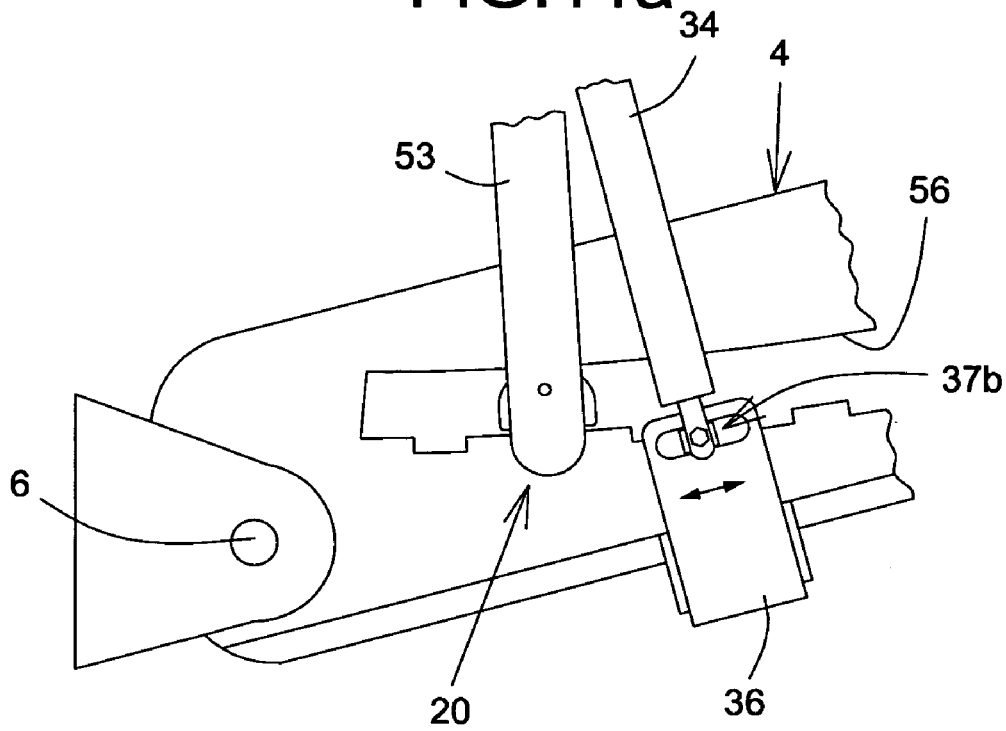

In FIG. 11*a*, the rods 34 are fixedly mounted on the slider 36 via securing bolts 37*a* to restrain the dynamic weight inertia effect from the sliding motion of the slider 36. In FIG. 11*b*, the dynamic weight inertia effect is slightly enhanced by the rods 34 being slidably mounted, in a direction typically parallel to the slider displacement direction, on the slider 36 via a slot-square shaft arrangement 37*b* or the like, the arrangement providing a smooth (not jerked) sliding.

Figure 11C:
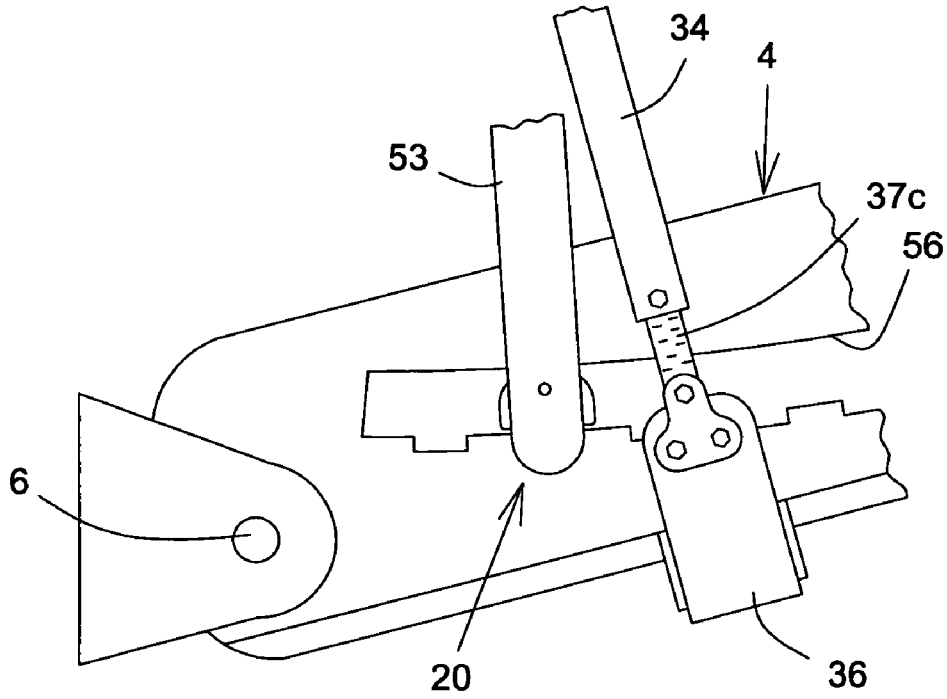
Figure 11D:
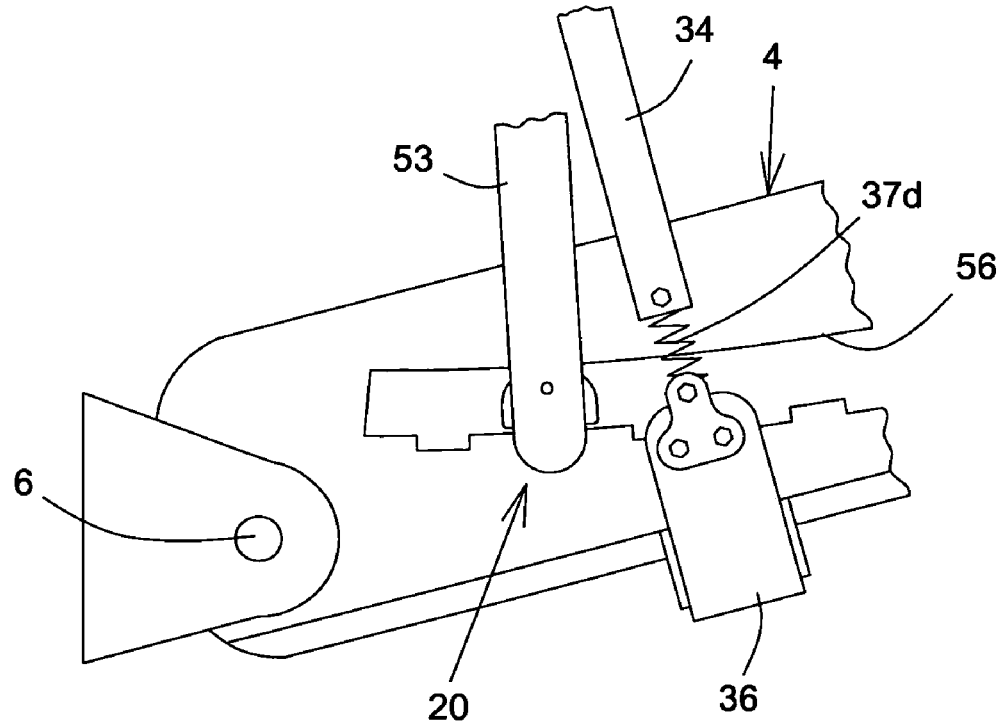

In FIGS. 11*c* and 11*d*, the rods 34 movably mounted on the slider 36 via flexible links, such as a rubber-type piece 37*c*, a helical spring 37*d*, respectively, or the like flexible arrangement, further enhance the dynamic weight inertia effect to the apparatus 1 from the sliding motion of the slider 36.

Figure 12A:
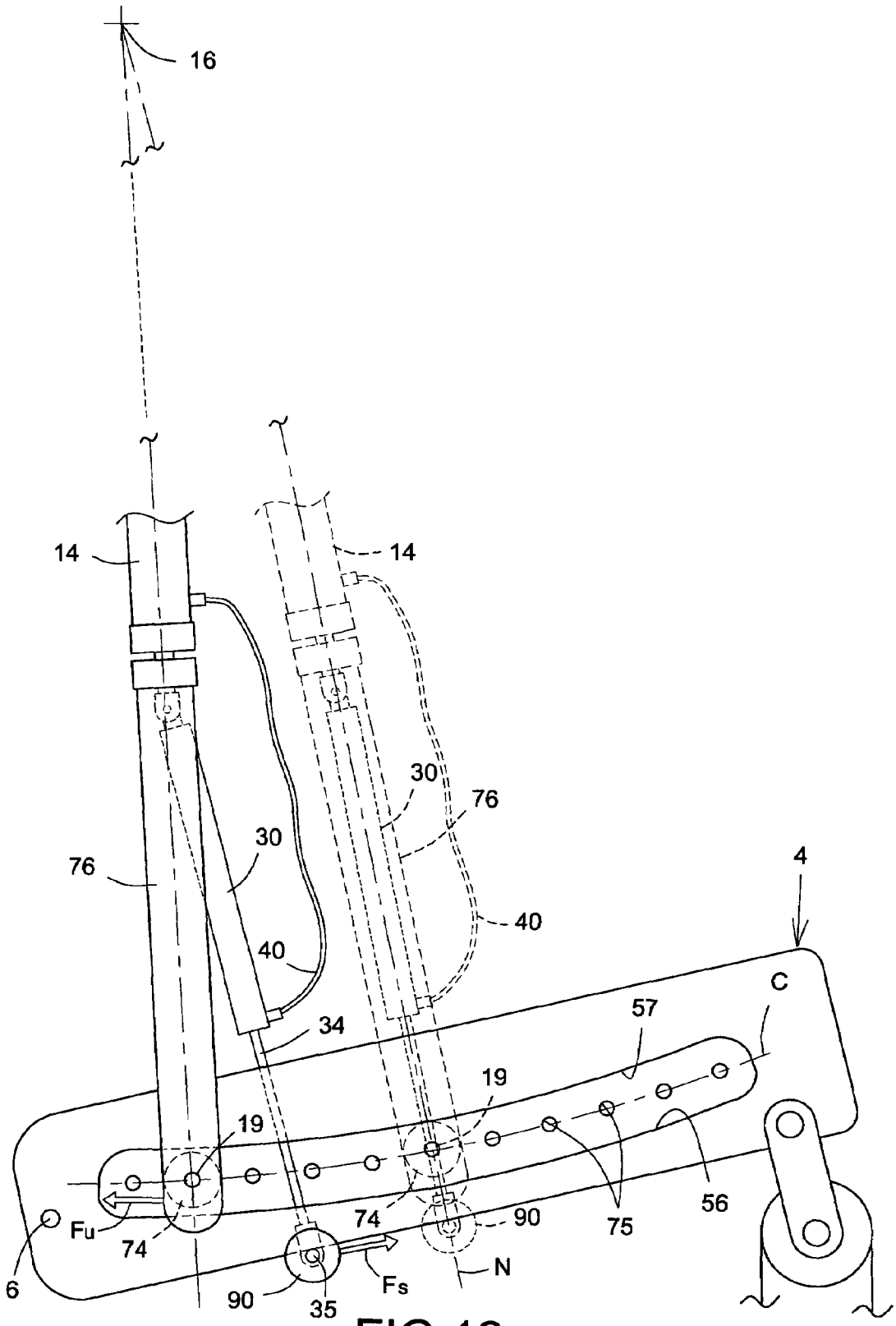
FIGS. 12*a* and 12*b* are enlarged broken views similar to the embodiment of FIG. 7, schematically showing the relative force required from a user to position the main cylinder along the guideway away from a neutral position thererof, with the guideway arcuate guide following a constant radii curve and a gradually decreasing radii curve when leading away from the neutral position, respectively.

Referring now to FIG. 12*a*, there is schematically shown the relative force Fu required from a user to position the second primary end (piston rod 18) of the primary cylinder assembly 14 along the guideway 4 away from a neutral position N, with the arcuate guideway slot 56 (or any other arcuate guide or the like) having a smooth upper margin 57 rollably engaged by the roller 74 whose pivot axis 19 is further a pin or the like that lockingly engages one of the different position holes 75 following a generally constant radii curve C about the first primary end pivot point 16 when leading away from the neutral position N wherein the primary and secondary cylinders 14, 30 are generally parallel to one another (as shown in dotted lines in FIGS. 12*a* and 12*b*), since the secondary cylinder 30 tends to remain into the neutral position with force Fs. This user applied force Fu might get significant enough to prevent a young or weak user from locating the primary piston 14 in position holes 75 at either ends of the slot 56. In order to reduce that amount of effort required by the user, illustrated by smaller force Fu' in FIG. 12*b*, the guideway slot 56' is preferably shaped with a gradually decreasing radii curve C', about the first primary end pivot point 16, when leading away from the neutral position N, as illustrated in solid lines (relative to dotted lines) in FIG. 12*b*. This decreasing radii curved slot 56', with corresponding position holes 75', essentially compensates for the retention force Fs exerted by the secondary cylinder 30 by allowing the primary cylinder 14 to contract while the secondary cylinder 30, operatively or fluidly interconnected to the primary cylinder 14, is forced to expand and pulls with force Fp while getting away from the neutral position N.

Figure 12B:
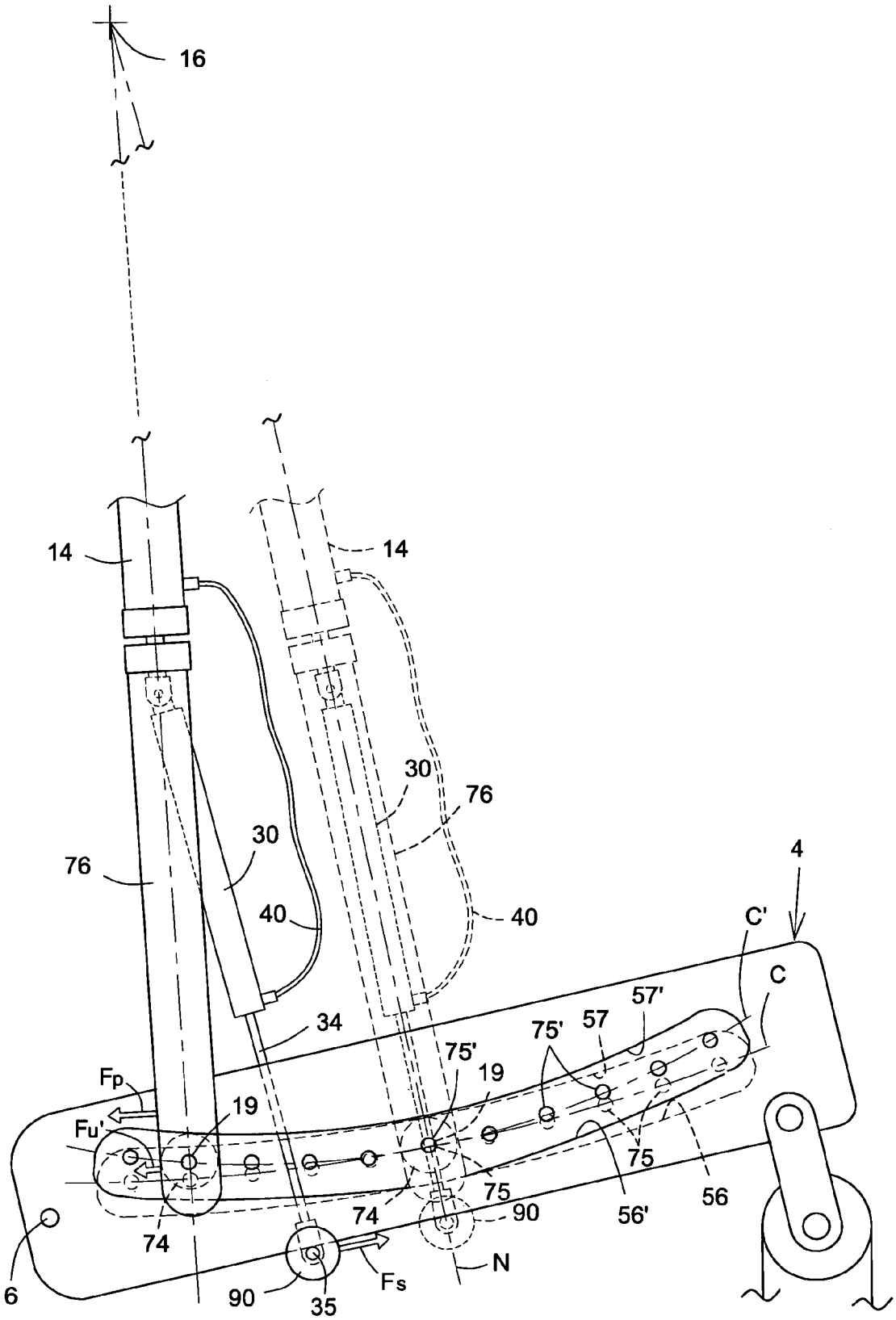

Depending on the design parameters (actual angles and the like), the force Fp exerted by the primary cylinder 14 could happen to be slightly larger than the resistive force Fs from the secondary cylinder 30 such that the user's force Fu' could be negative (in the opposite direction than illustrated in FIG. 12*b*). It is to be noted that the neutral position N could be anywhere along the arcuate guide, or even away therefrom (virtually out of the guideway 4), and not necessarily at its geometrical center. Also, as it would be readily understood by one skilled in the art, the gradually decreasing radii curve C' could be formed with a constant smaller radii about a point located closer to the guideway 4 than the first primary end pivot point 16.

Although the above description refers to resistance provided by pull-type cylinders (or other pull-type load resistant members), it would be obvious to one skilled in the art to use push-type cylinders (or other push-type load resistant members) without departing from the scope of the present invention.

In order to further control the dynamic weight inertia effect response of the apparatus 1, some weight (not shown) could be selectively added/removed to the slider 36 or rollers 90 of FIGS. 1 to 4 since the gravity effect works in the same direction as the sliding movement direction of the secondary second end or piston rod(s) 34 on the guideway 4. Additionally, when the guideway 4 is below the cylinders 14, 30 as in FIGS. 5 to 9, some hanging weight W or the like biasing force (as shown in dotted lines in FIG. 7) could be even connected to the slider 36 to reorient the resulting gravity effect in the same direction as the sliding inertial effect of the piston(s) 34 on the guideway 4 by counteracting the direct effect of gravity on the slider 36 that would otherwise tend to generate some shuddering of its sliding movement.

Although the present weight lifting simulator apparatus has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A weight lifting simulator apparatus comprising a frame, a guideway pivotally mounted on the frame for activation by a user, a primary load resistant member having generally opposed first and second primary ends respectively movably mounted on the frame and pivotally and adjustably securable to the guideway at a desired position therealong, at least one secondary load resistant member having generally opposed first and second secondary ends respectively mounted in pivoting fashion in relation to-and adjacent the second primary end and connected to a slider associated with and movable relative to the guideway so as to remain substantially perpendicular thereto, the primary and secondary load resistant members being operatively interconnected in such manner as to provide a generally constant resistance with dynamic weight inertial effect upon activation of the guideway by the user, whereby in use upon activation of the guideway the user encounters a dynamically reduced resistance for increased weight inertial effect from both the primary and secondary load resistant members after initial activation of the guideway depending on the displacement speed thereof.

2. Apparatus according to claim 1 wherein the first primary end is pivotally mounted on the frame and the second secondary end is pivotally mounted on the slider.

3. Apparatus according to claim 2 wherein the primary and secondary load resistant members are fluid actuatable cylinders.

4. Apparatus according to claim 3 wherein the primary and secondary cylinders are fluidly interconnected in such manner as to constantly provide a uniform internal pressure therein.

5. Apparatus according to claim 4 wherein two secondary cylinders are provided, and mounted in parallel relative to one another.

6. Apparatus according to claim 1 wherein a clamp is provided for the securement of the second primary end to the guideway.

7. Apparatus according to claim 1 wherein a stepped adjustment mechanism is provided for the securement of the second primary end to the guideway.

8. Apparatus according to claim 7 wherein the stepped adjustment mechanism is in the form of a rack with a resiliently-loaded detent engageable with the interstices of the rack.

9. Apparatus according to claim 8 wherein the rack is arcuate.

10. Apparatus according to claim 8 wherein the resiliently-loaded detent is remotely operable by means of a cable actuable upon the detent.

11. Apparatus according to claim 7 wherein the stepped adjustment mechanism includes a scalloped slot formed in the guideway, a cam-operable roller engageable with a selected one of the scallops in the slot.

12. Apparatus according to claim 11 wherein the slot is arcuate.

13. Apparatus according to claim 11 wherein the cam-operable roller is carried on a yoke having a bridge with a bridge collar mounted adjacent the second primary end, and a fixed collar connected adjacent to the first primary end having pivotally mounted thereon a lever carrying a cam operable upon the bridge collar of the yoke, whereby in use operation of the lever and the cam moves the cam-operable roller into or out of engagement with a scallop in the guideway slot.

14. Apparatus according to claim 1 wherein the slider associated with the guideway includes at least one roller or a linear type bearing engageable with the guideway.

15. Apparatus according to claim 1 wherein the secondary load resistant member is further attached to the primary load resistant member in sliding manner through the agency of a mount providing for resiliently-biased linear movement and secured to and adjacent the second primary end so as to further dynamically increase weight inertial effect from both the primary and secondary load resistant members after initial activation of the guideway depending on the displacement speed thereof.

16. Apparatus according to claim 15 wherein the guideway is pivotally mounted on the frame at a pivot axis and the linear movement is along a linear movement axis oriented towards the guideway in a direction away from the pivot axis relative to the first secondary end.

17. Apparatus according to claim 16 wherein the linear movement axis is angularly adjustable relative to the guideway for adjustment of the dynamically increased weight inertial effect from the secondary load resistant member.

18. Apparatus according to claim 1 further including a user handle connected to the guideway for activation thereof by the user.

19. Apparatus according to claim 18 wherein a cable member and pulley arrangement connects the handle to the guideway.

20. Apparatus according to claim 18 wherein the handle is mounted on an extension of the guideway extending longitudinally away from a pivot axis thereof.

21. Apparatus according to claim 1 wherein the primary and secondary load resistant members are pull-type load resistant members.

22. Apparatus according to claim 1 wherein the second secondary end is fixably mounted on the slider.

23. Apparatus according to claim 1 wherein the second secondary end is movably mounted on the slider.

24. Apparatus according to claim 23 wherein the second secondary end is pivotally mounted on a pivot axis substantially intersecting a sliding axis of the slider moving relative to the guideway.

25. Apparatus according to claim 1 wherein the first primary end is slidably mounted on an arcuate guide rail of the frame so as to be virtually pivotally mounted on the frame.

26. Apparatus according to claim 1 wherein second primary end is pivotally and adjustably securable to the guideway along an arcuate guide.

27. Apparatus according to claim 26 wherein said arcuate guide has a gradually decreasing radii curve shape about a pivot mounting point of said first primary end when leading away from a neutral position thereof in which said primary and secondary load resistant members are generally parallel to one another.

* * * * *